United States Patent [19]

Lüderitz

[11] 4,204,274

[45] May 20, 1980

[54] WALL LIGHT FIXTURE, PARTICULARLY FOR HOSPITAL ROOMS

[76] Inventor: Willi Lüderitz, Westerbachstrasse 27, 4990 Lübbecke, Fed. Rep. of Germany

[21] Appl. No.: 918,514

[22] Filed: Jun. 23, 1978

[30] Foreign Application Priority Data

Jun. 25, 1977 [DE] Fed. Rep. of Germany ... 7719975[U]

[51] Int. Cl.² ..... F21V 1/00

[52] U.S. Cl. ..... 362/239; 362/220; 362/225; 362/240; 362/287; 362/804

[58] Field of Search ..... 362/141, 219, 220, 225, 362/233, 238, 239, 240, 244, 287, 371, 372, 804

[56] References Cited

U.S. PATENT DOCUMENTS

| | | | |
|---|---|---|---|
| 2,536,203 | 2/1951 | Meyers | 362/220 X |
| 2,544,708 | 3/1951 | Margolis | 362/220 X |
| 2,590,657 | 3/1952 | Shepard | 362/128 X |
| 2,675,465 | 4/1954 | Saelen | 362/295 |
| 2,998,508 | 8/1961 | Bobrick | 362/239 X |
| 3,200,244 | 8/1965 | Meyer | 362/225 |
| 3,201,582 | 8/1965 | Siegel | 362/295 |
| 4,104,710 | 8/1978 | Damico et al. | 362/295 X |

*Primary Examiner*—Peter A. Nelson

*Attorney, Agent, or Firm*—Max Fogiel

[57] ABSTRACT

A wall light fixture, particularly for hospital rooms or sickrooms, in which a room light fixture and a reading light fixture are connected, and can be tilted from a room lighting position to a reading position, and vice versa. The reading light fixture with its housing is seated in a carrier to be attached to the wall of a room. The room light fixture mounted in this carrier or on the housing of the reading light fixture, can be tilted from the room lighting position to the reading position. The position of the room and reading light fixture relative to each other is adjustable, and the housing of the reading light fixture has a recess or chamber into which the room light fixture with its housing can fit. The housings of the room and reading light fixture are connected by a hinge or joint extending over the length of the light fixture. Stops may be applied to restrict the relative adjustment of the two light fixtures.

12 Claims, 5 Drawing Figures

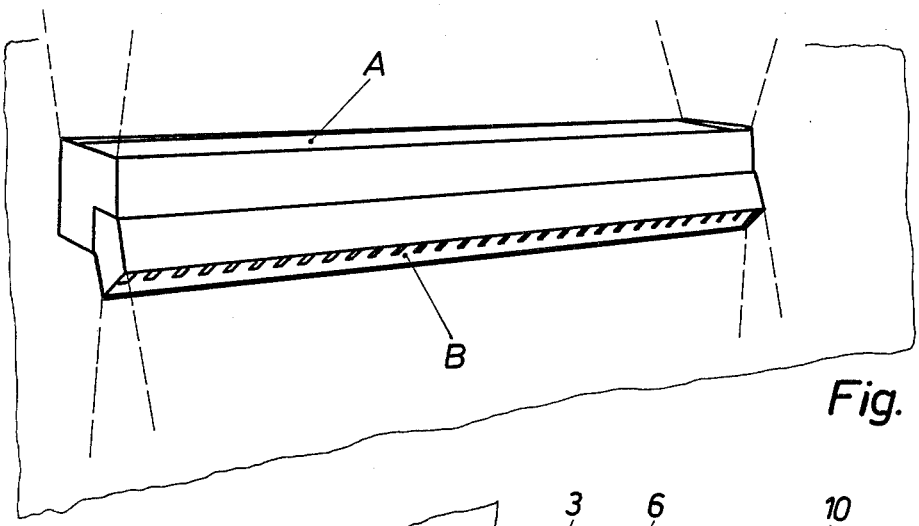
Fig. 1
Fig. 2
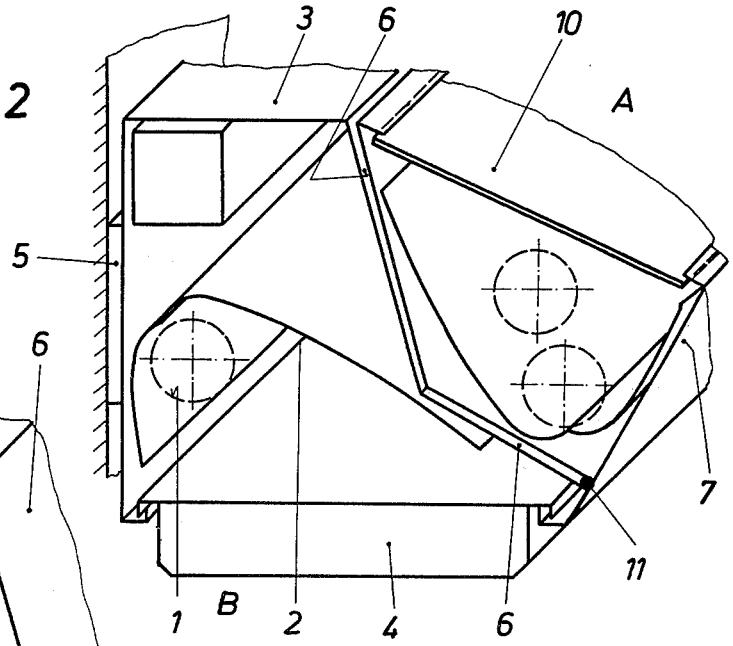
Fig. 3
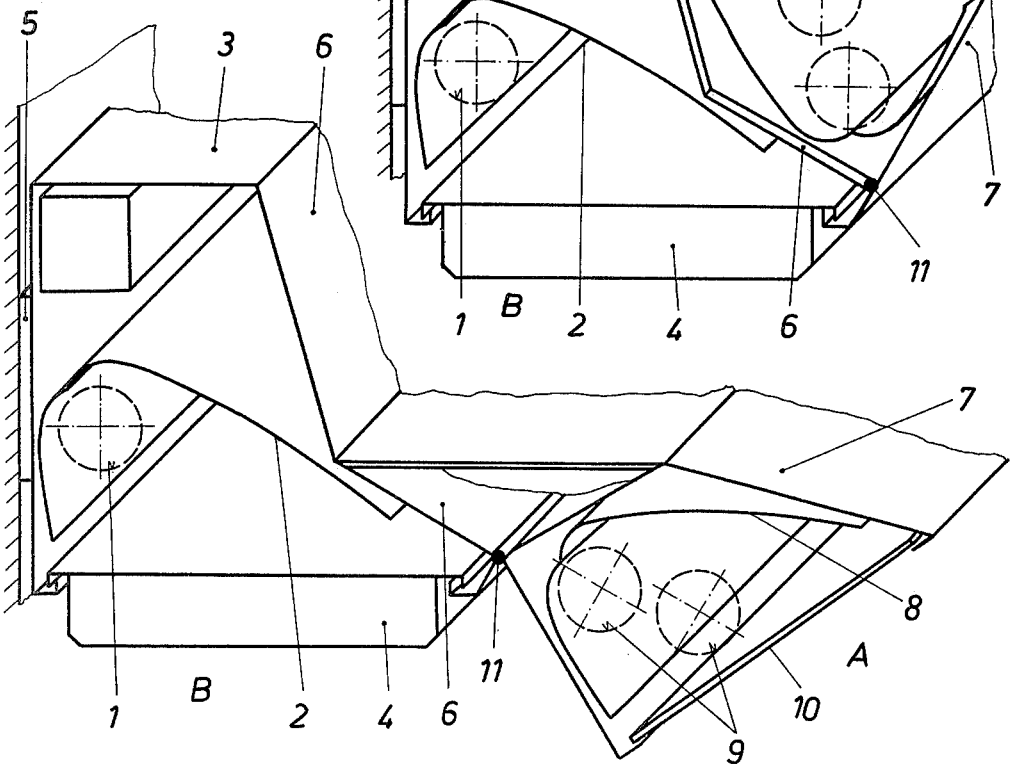

Fig. 4
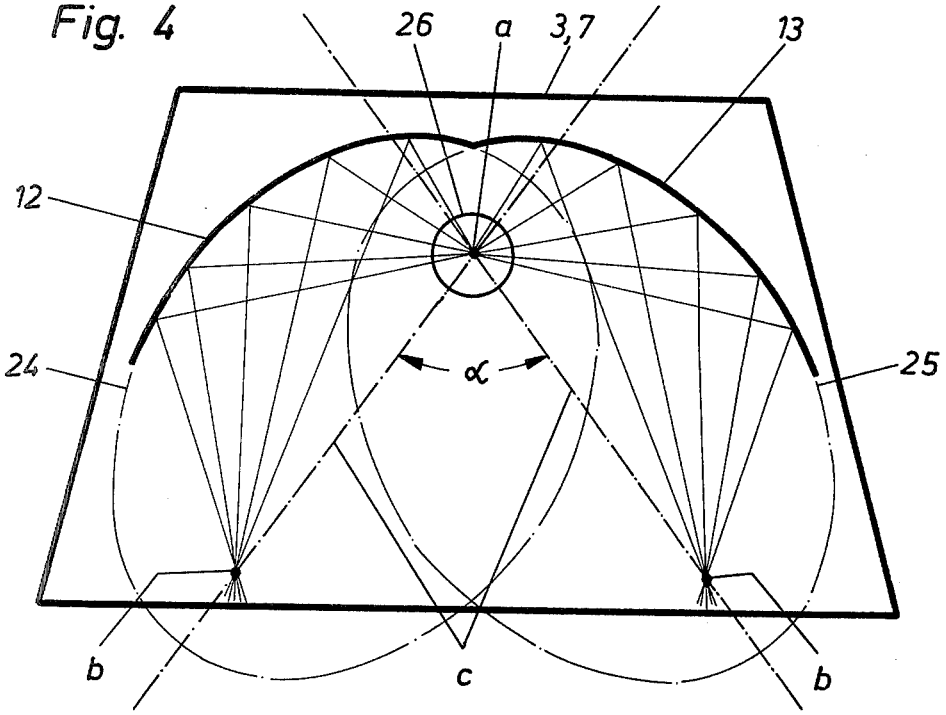
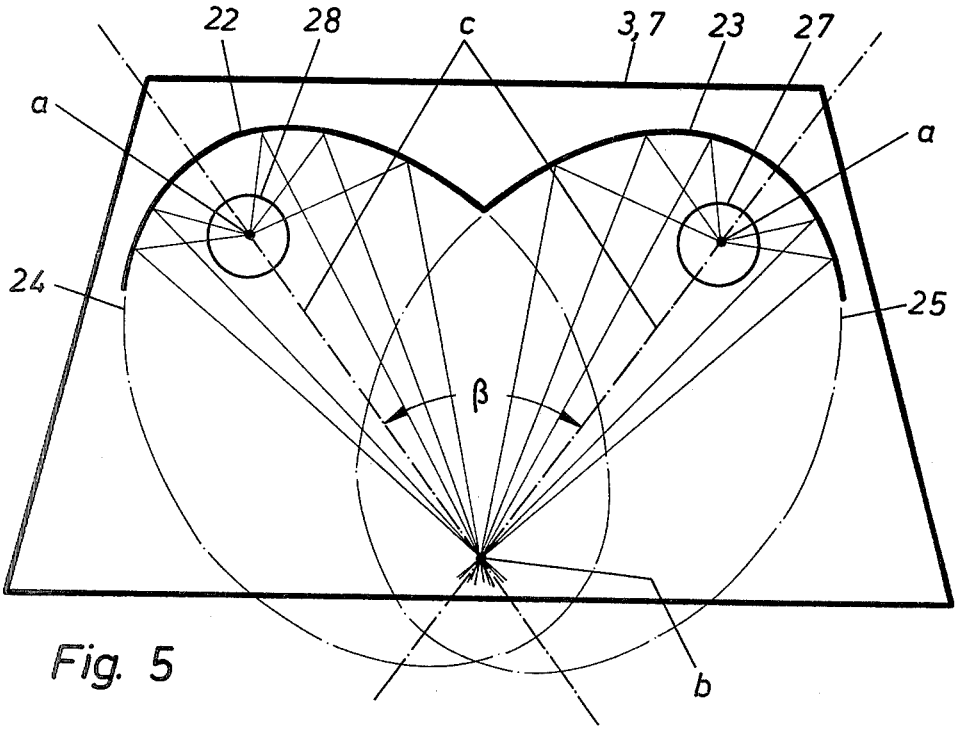
Fig. 5

WALL LIGHT FIXTURE, PARTICULARLY FOR HOSPITAL ROOMS

BACKGROUND OF THE INVENTION

The present invention relates to a wall light fixture to be used for sickrooms but also quite generally in rooms where by means of a light fixture attached to the wall, an object underneath, for example a bed, a seat, a picture etc. and the room as a whole are to be illuminated. Usually such wall light fixtures consist of an upward directed room light fixture and a downward directed reading lamp which can be switched on alternately or both together. In certain cases, when the area lit by the reading lamp is to be lit more intensely, such wall light fixtures have the shortcoming that the luminous intensity of the reading lamp is not sufficient. This shortcoming manifests itself particularly in sickrooms where the patient can read lying in bed when the reading lamp is switched on, but the amount of light furnished by the reading lamp is not sufficient for an examination by the treating physician.

It is an object of the present invention to remedy this shortcoming and to provide a wall light fixture which permits more intense illumination of the area illuminated by the conventional reading lamp in specific cases.

SUMMARY OF THE INVENTION

This is achieved by the present invention in that room and/or reading light fixture are connected and can be flipped from a room lighting position into a reading position—and vice versa. The reading light fixture with its housing is located in a known manner on a carrier to be attached to the wall while the room light fixture is mounted in this carrier or at the housing of the reading light fixture and can be flipped from the room lighting position to the reading position. This provides the possibility of illuminating the area illuminated by the reading light fixture by means of the room light fixture at any time resetting the room light fixture.

It is particularly advantageous when in the housing of the room and/or reading light fixture there is provided a reflector for the light source; this reflector consists of two abutting curved surfaces whose cross-section consists of portions of ellipses having one focus in common and whose major axes, intersecting at this focus, form an angle; to achieve divergent light, a light source, preferably a fluorescent tube is located at the focus common to both ellipses. To achieve convergent radiation, a light source each is located at that focus of each ellipse which is not an intersection of the major axes. This provides a so-called "tri-focal" arrangement of the light sources and the associated reflector.

To regulate the illumination, room and/or reading light fixture can be adjusted in their position relative to each other. Preferably, the housing of the reading lamp has a recess, a chamber etc. into which the room light fixture with its housing will fit. The housings of room and reading light fixtures are expediently connected by a hinge, joint etc. extending throughout the length of the light fixture. The adjustment of the two light fixtures relative to each other can be restricted by stops, etc.

The concept of the invention permits various possible embodiments. One embodiment is disclosed in the accompanying drawing which shows:

BRIEF DESCRIPTION OF THE DRRAWINGS

FIG. 1 shows a perspective view of a wall in a room with a conventional wall light fixture attached; and FIGS. 2 and 3 show perspective views of the light fixture in accordance with the present invention at two different settings, with the sidewall facing the observer being omitted;

FIGS. 4 and 5 show a section through the housing of a light fixture for different placement of the light sources.

DESCRIPTION OF THE PREFERRED EMBODIMENTS

Referring to FIG. 1, the wall light fixture consists of a room light fixture, denoted by A, and a reading lamp B. Ordinarily such wall light fixtures are equipped with fluorescent lamps where, depending on need, the upward lighting room light fixture A or the downward lighting reading lamp B or both fixtures can be switched on together.

In the embodiment of the wall light fixture of FIGS. 2 and 3, the reading lamp consists of a fluorescent tube 1 which is located in front of a reflector 2 open on the downward side in a housing 3, with a transparent or translucent lamp cover at the underside of the housing. The housing 3 is fastened by means of a mounting bar 5 on the wall and has the usual circuit elements, including terminals, sockets, etc. on the inside.

On the side facing away from the wall, housing 3 has a recess, chamber, etc. 6 which is intended for accommodating housing 7 of the room light fixture.

The outer shape of this housing 7, as shown in FIG. 2, is adapted to the shape of chamber 6 in housing 3. The room light fixture again has a reflector 8 placed in housing 7; in front of this reflector there are one or two fluorescent tubes 9. Electrical connections and circuit elements are not shown. On the open side, housing 7 is covered by a transparent or translucent cover 10, for example a prism or similar item.

The two housings 3 and 7 are joined by a hinge 11 so that it is possible to flip the room light fixture A from the position in FIG. 2 to the position of FIG. 3 in order to intensify the lighting effect of the reading lamp for special occasions. When not in use, the room light fixture A can be flipped back to the position of FIG. 2 where it fits perfectly into housing 3 so that the entire wall light fixture has a compact appearance. Of course the design, particularly that of room light fixture A, can be made such that it illuminates the wall area in the position of FIG. 2 and a possible dazzling effect towards the light fixture forward side is prevented. Ther also may be adjustment features (not shown) so that the inclination or adjustment of the room light fixture can be adapted to prevailing conditions.

Furthermore, the design of the various housing sections and fixtures is not tied to the use of fluorescent tubes. Individual incandescentlamps, arranged in rows, may also be used.

It is particularly advantageous both for the room light fixture A and for the reading lamp B if the light sources are arranged in a so-called tri-focal system. In this case, there is provided a reflector in housing 3 or 7 of reading or room fixture or in both. This reflector extends over the length of the associated fluorescent tubes and, in case of FIG. 4, is composed of reflector sections 12, 13, and in case of FIG. 5 of reflector sections 22, 23. These sections are formed in such a way that their cross-sections are portions of an ellipse 24 or 25. The two ellipses, which may be of equal or different size depending on the desired lighting effect, are arranged so that they have one of their foci a or b in common. In case of FIG. 4 they share foci a and in case of FIG. 5 foci b. Also, the two ellipses 24 and 25 are located so that their major axis c intersect in the common foci. In FIG. 4, axes c intersect at point a and make an angle $\alpha$ open in the downward direction; in FIG. 5 the intersection is at b and angle $\beta$ is open in the upward direction.

The two reflector sections 12, 13 or 22, 23 may also be adjustable relative to each other. To achieve diverging light according to FIG. 4, a light source 26, preferably a fluorescent tube is located at focus a common to both ellipses 24 and 25; to achieve converging radiation according to FIG. 5, light sources 27 and 27 are located at that focus a of each ellipse 24 and 25 which is not an intersection of the major axes. In this manner, the ellipse arrangements shown in FIGS. 4 and 5 use the three foci available for locating the light sources, realizing the "tri-focal" system. Depending on the desired lighting conditions, either the reflector and light source arrangement of FIGS. 4 and 5 are used.

I claim:

1. A wall light fixture arrangement for hospital rooms, sickrooms and the like, comprising: a room light fixture; a reading light fixture; means for connecting said room light fixture and said reading light fixture; and means for tilting said room light fixture and said reading light fixture relative to each other from a room lighting position to a reading position, said room light fixture and said reading light fixture being also tiltable relative to each other from a reading position to a room light position; said room lighting fixture and said reading light fixture being separately tiltable independently of each other, said room lighting fixture being tiltable relative to said reading light fixture to reinforce the light intensities of each other for concentrating light on a predetermined area.

2. An arrangement as defined in claim 1 including a housing for said reading light fixture; carrier means for seating said reading light fixture with said housing and being attachable to a wall of a room.

3. An arrangement as defined in claim 1 wherein the relative position of the room light fixture and said reading light fixture is adjustable.

4. An arrangement as defined in claim 2 wherein said housing for said reading light fixture has recess means for holding said room light fixture.

5. An arrangement as defined in claim 1 including a housing for said light fixture and a housing for said reading light fixture; and means for connecting said housings and extending over the length of said light fixture arrangement.

6. An arrangement as defined in claim 1 including stop means for restricting variably relative adjustment of said room light fixture and said reading light fixture.

7. A wall light fixture arrangement for hospital rooms, sickrooms and the like, comprising: a room light fixture; a reading light fixture; means for connecting said room light fixture and said reading light fixture; and means for tilting said room light fixture and said reading light fixture relative to each other from a room lighting position to a reading position, said room light fixture and said reading light fixture being also tiltable relative to each other from a reading position to a room lighting position; housing means for said room light fixture and said reading light fixture; light source means; reflector means for said light source means and comprising two intersecting curved surfaces having cross-sections formed from portions of ellipses, said ellipses having one focus in common, said ellipses having their major axes intersecting at said common focus and forming a predetermined angle therebetween, said light source means being located at said common focus to both ellipses for producing divergent light.

8. An arrangement as defined in claim 7 wherein said reflector means has two sections adjustable relative to each other.

9. An arrangement as defined in claim 7 wherein said ellipses are of different size.

10. A wall light fixture arrangement for hospital rooms, sickrooms and the like, comprising: a room light fixture; a reading light fixture; means for connecting said room light fixture and said reading light fixture; and means for tilting said room light fixture and said reading light fixture relative to each other from a room lighting position to a reading position, said room light fixture and said reading light fixture being also tiltable relative to each other from a reading position to a room lighting position; housing means for said room light fixture and said reading light fixture; light source means; reflector means for said light source means and comprising two intersecting curved surfaces having cross-sections formed from portions of ellipses, said ellipses having one focus in common, said ellipses having their major axes intersecting at said common focus and forming a predetermined angle, said light source means comprising two light sources each located at a focus of each ellipse which is spaced from said common focus for producing convergent light.

11. An arrangement as defined in claim 10 wherein said reflector means has two reflector sections adjustable relative to each other.

12. An arrangement as defined in claim 10 wherein said ellipses are of different size.

* * * * *